US007824148B2

(12) United States Patent
Tetu et al.

(10) Patent No.: US 7,824,148 B2
(45) Date of Patent: Nov. 2, 2010

(54) CENTRIFUGAL COMPRESSOR PERFORMANCE BY OPTIMIZING DIFFUSER SURGE CONTROL AND FLOW CONTROL DEVICE SETTINGS

(75) Inventors: Lee George Tetu, Baldwinsville, NY (US); Joost J. Brasz, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 933 days.

(21) Appl. No.: 11/631,766

(22) PCT Filed: Jul. 13, 2005

(86) PCT No.: PCT/US2005/025116

§ 371 (c)(1),
(2), (4) Date: Jan. 4, 2007

(87) PCT Pub. No.: WO2006/017365

PCT Pub. Date: Feb. 16, 2006

(65) Prior Publication Data

US 2007/0248453 A1 Oct. 25, 2007

(51) Int. Cl.
*F04D 27/02* (2006.01)
*F01B 25/00* (2006.01)
*F01D 17/00* (2006.01)

(52) U.S. Cl. ..... 415/1; 415/26; 415/148

(58) Field of Classification Search ..... 415/1, 415/17, 23, 26, 30, 47, 48, 49, 148, 150, 415/211.2; 416/162

See application file for complete search history.

(56) References Cited

U.S. PATENT DOCUMENTS

| | | | | |
|---|---|---|---|---|
| 4,503,684 | A | 3/1985 | Mount et al. | |
| 4,586,870 | A | 5/1986 | Hohlweg et al. | |
| 4,686,834 | A * | 8/1987 | Haley et al. | 62/209 |
| 5,095,714 | A | 3/1992 | Adachi et al. | |
| 5,618,160 | A | 4/1997 | Harada et al. | |
| 5,683,223 | A | 11/1997 | Harada et al. | |
| 5,851,103 | A | 12/1998 | Harada et al. | |
| 5,913,248 | A | 6/1999 | Harada et al. | |
| 5,927,939 | A * | 7/1999 | Harada et al. | 415/17 |
| 5,947,680 | A * | 9/1999 | Harada et al. | 415/17 |

FOREIGN PATENT DOCUMENTS

| | | |
|---|---|---|
| CN | 1118876 A | 3/1996 |
| EP | 0212971 A2 | 3/1987 |
| KR | 10-0386179 | 5/2003 |

OTHER PUBLICATIONS

Korean Office Action Dated Oct. 9, 2007, for Korean Patent Application No. 1020077000769.

(Continued)

*Primary Examiner*—Edward Look
*Assistant Examiner*—Sean J Younger
(74) *Attorney, Agent, or Firm*—Bachman & LaPointe, P.C.

(57) ABSTRACT

A method is provided for controlling operation of a compressor having an inlet and an outlet, a variable geometry diffuser communicated with the outlet, and inlet guide vanes communicated with the inlet, wherein the method includes the steps of: determining a loading parameter indicative of onset of surge; and independently controlling the inlet guide vanes and the variable geometry diffuser based upon the loading parameter so as to allow increase in efficiency and stable operation of the compressor.

8 Claims, 10 Drawing Sheets

OTHER PUBLICATIONS

Derwent Abstract Accession No. 96-237218/24, JP 08093502 A (Mitsubishi Jukogyo KK) Apr. 9, 1996, Abstract and figure.
Chinese Office Action for CN200580023685.0, dated Jan. 9, 2009.
EP Search Report for EP Patent Application No. 057722159, dated Jun. 24, 2010.

* cited by examiner

CENTRIFUGAL COMPRESSOR PERFORMANCE BY OPTIMIZING DIFFUSER SURGE CONTROL AND FLOW CONTROL DEVICE SETTINGS

BACKGROUND OF THE INVENTION

Surge control problems have been around as long as the centrifugal compressor itself. Many different approaches have been taken to improve operating range to surge (both in head and flow) depending on what type of surge mechanism is present in the compressor system. Compressor surge triggered by diffuser stall can be suppressed by variable diffuser geometry, whereas surge from impeller stall can be eliminated by the use of variable-geometry inlet guide vanes.

A given compressor duty in terms of flow and pressure ratio can be realized by an infinite number of combinations of inlet guide vane/variable diffuser geometry settings. These various realizations of the same duty point have different compressor efficiencies.

The need exists for an improved method for selecting specific combinations to improve efficiency while maintaining surge-free operation of the compressor, and it is the primary object of the present invention to respond to this need.

SUMMARY OF THE INVENTION

According to the invention, the foregoing objects and advantages have been readily attained.

The present invention provides a method that allows for optimal inlet guide vane/variable-geometry diffuser positioning using a plurality, preferably two or three pressure measurements along the flow path, for example, impeller inlet pressure, impeller exit/diffuser inlet pressure and diffuser exit pressure. Maximum obtainable diffuser pressure recovery can be used to determine the onset of surge. These maximum pressure recovery values are a function of variable-geometry diffuser setting only and are independent of flow, head or inlet guide vane setting over most of the operating range. Further, they can quickly be determined experimentally by pressure measurements. During operation, the known maximum pressure recovery value can be compared to one determined from real time pressure measurements, and a determination as to the optimal setting of the diffuser can be made. According to the invention, it appears that for the most efficient operation of a compressor, the diffuser should be positioned such that its pressure recovery value is close to its maximum. This in effect brings surge close to the operating point, but with careful control and safety factors, stable operation is accomplished.

In one aspect of the present invention, a method is provided for controlling operation of a compressor having an inlet and an outlet, a variable geometry diffuser communicated with the outlet, and inlet guide vanes communicated with the inlet, comprising the steps of determining a loading parameter indicative of onset of surge; and independently controlling the variable geometry diffuser and at least one of compressor speed and the inlet guide vanes based upon the loading parameter so as to allow increase in efficiency and stable operation of the compressor.

In another aspect of the invention, a method for controlling operation of a compressor having at least two controllable operating parameters which affect operating stability, comprising the steps of determining a loading parameter indicative of onset of surge, an operating value of the loading parameter being controllable by each of the at least two controllable operating parameters; and independently controlling at least one of the at least two controllable operating parameters based upon the loading parameter so as to operate at a desired efficiency within a stable operating zone of the compressor.

BRIEF DESCRIPTION OF THE DRAWINGS

A detailed description of preferred embodiments of the present invention follows, with reference to the attached drawings, wherein.

DETAILED DESCRIPTION

Figure 1:
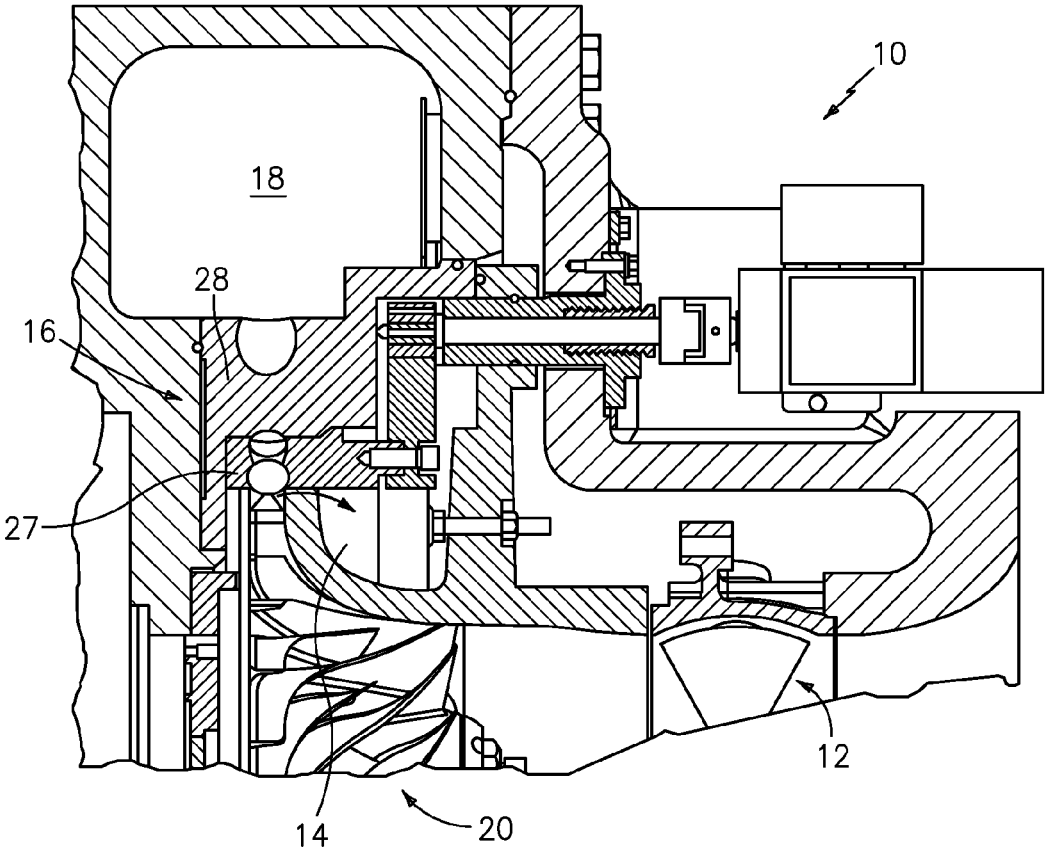
FIG. 1 is a sectional view through a centrifugal compressor showing structure relevant to the present invention.

The invention relates to control of centrifugal compressors and, more particularly, to a system and method for operating such compressors wherein performance is improved through independent control and balancing of a variable geometry diffuser and at least one of inlet guide vanes and compressor speed. The following description is given in terms of controlling the diffuser and inlet guide vanes, and this is a preferred embodiment, but this is not limiting upon the broad scope of the invention.

Pushing efficiency numbers higher has long been the goal of centrifugal compressor designers. Of course there is also the desire for stable, wide ranged compressor operation. In many instances, these desirable features are not mutually inclusive. In accordance with the present invention, these features are carefully balanced through application of a metric which relates loading to the onset of surge conditions.

For centrifugal compressors, one particularly useful loading parameter is pressure ratio across the diffuser. See table pressure measurements or approximations can readily be obtained during operation of a compressor and such measurements are closely related to onset of surge. According to the invention, operation of the compressor is controlled based upon current values of this parameter and known correlations of values which lead to surge, and this allows for improved control.

According to the invention, different flow control mechanisms provide different results in terms of stability and efficiency. For the centrifugal compressor of the present invention, it has been found that efficiency is greatest for a particular duty point, with the diffuser as open as possible without causing surge. Control based upon the loading parameter, in this case, pressure rise across the diffuser, allows for maximizing efficiency within reasonable safety factors by utilizing the best possible setting of the diffuser from an efficiency standpoint, while maintaining control at least a safety factor distant from surge.

For example, if a given compressor is operating with the diffuser partially open and a call is received by the compressor controller requesting greater pressure rise, this needed increase is evaluated to determine if it can be met by opening the diffuser further. If so, the diffuser is used to meet the new operating condition. If the loading parameter indicates that the requested increase would cause surge if implemented by controlling the diffuser, then control is instead implemented through the alternative mechanism, in this particular embodiment through control of the inlet guide vanes. By prioritizing the mechanism to control, and controlling it independently of the other, maximum stable efficiency is accomplished.

As set forth above, one method of stability control is obtained through the use of variable diffuser geometry. In many cases the variable geometry configuration controls not only stability of the compressor system but the flow rate as well. In the case where another flow control device is used (i.e. Inlet Guide Vanes), there is the possible trade-off of performance versus efficiency for the different combinations of settings.

The present invention is drawn most preferably to a pipe diffuser-type variable diffuser geometry device. Performance, benefits and some geometric sensitivities of this type of diffuser have been described. Previously, a simple optimization scheme was detailed to determine the most efficient combination of diffuser/IGV settings using no measured information of the flow field or operating parameters except the actual diffuser/IGV orientation. The result was a one-to-one, dependent correspondence of IGV location to diffuser orientation based on certain criterion. This had the effect of allowing the surge line of the compressor to be tailored to a desired characteristic, but also gave away efficient operation at lower IGV settings and pressure duty.

The pressure recovery inside a variable geometry pipe diffuser has also been described. Data shows that an increase in the overall pressure recovery coefficient is obtained with opening the diffuser throat. According to the invention, and building on these teachings, the best operating condition is to open the diffuser as much as possible while avoiding surge.

The key to such optimization of the system is in understanding the basic flow phenomenon and using a flow measurement metric that can accurately, consistently and reliably determine the optimal positioning of the IGV and variable diffuser. According to the invention, a flow measurement metric is provided that shows the potential to determine the best positioning for efficient operation of a compressor at higher load points. Specifically, for the case of a compressor utilizing inlet guide vanes and a pipe diffuser with variable throat geometry, a loading parameter describing the pressure ratio across the diffuser can be shown to give valuable insight as to where surge will occur. This in turn allows for a maximum efficiency of operation to be obtained. In essence, the present invention describes an efficient operation of the diffuser while avoiding expensive mapping of all operating conditions (flow, pressure rise for all IGV/Diffuser orientation combinations) a priori. This is done by taking highly accurate measurements installed in field applications and measuring or estimating compressor flow rate in the field.

The compressor 10 according to the present invention is shown in FIG. 1. The components of interest from inlet to exit are the inlet guide vanes (IGV's) 12, typically composed of a plurality, preferable a set of seven, uncambered vanes, a back-swept twenty-two (22) bladed compressor (11 main, 11 splitters), a small vaneless space 14 to a pipe diffuser 16, and a constant cross-sectional area collector 18. The impeller 20 can be, for example, 15.852 inches in diameter, with a blade exit height of 0.642 inches. The exit angle can be approximately 50.0 degrees and the operational speed can be 9200 RPM running at a wheel Mach number ($U_{tip}/a_0$) of about 1.3. Of course, these are non-limiting examples of one suitable compressor.

This compressor is typically operated on a chiller system. The working gas (r134a) is pulled from an evaporator vessel, is compressed, and then discharged to a condenser vessel.

Pressure measurements can be made in the evaporator, condenser and a plenum adjacent and connected to vaneless space 14 before the diffuser (see FIG. 1). Pressure measurements inside plenum 14 can be used to get an approximation to the average pressure inside the vaneless space upstream of the diffuser inlet with minimal fluctuations and thus reduce more costly signal conditioning or expensive measurement devices.

The pipe diffuser geometry includes three (3) basic parts or portions (See FIG. 2*a*) including a short constant area throat 22 (which can for example be 0.642 inches in diameter), a first length or flow path portion 24 which may have a divergence of, for example, 4-degrees, and then a second length or flow path portion 26 which may have a divergence of, for example, 8 degrees. Of course, it should be appreciated that the diameters and divergences are given as non-limiting examples only, and other configurations would certainly fall well within the broad scope of the present invention.

Figure 2A:
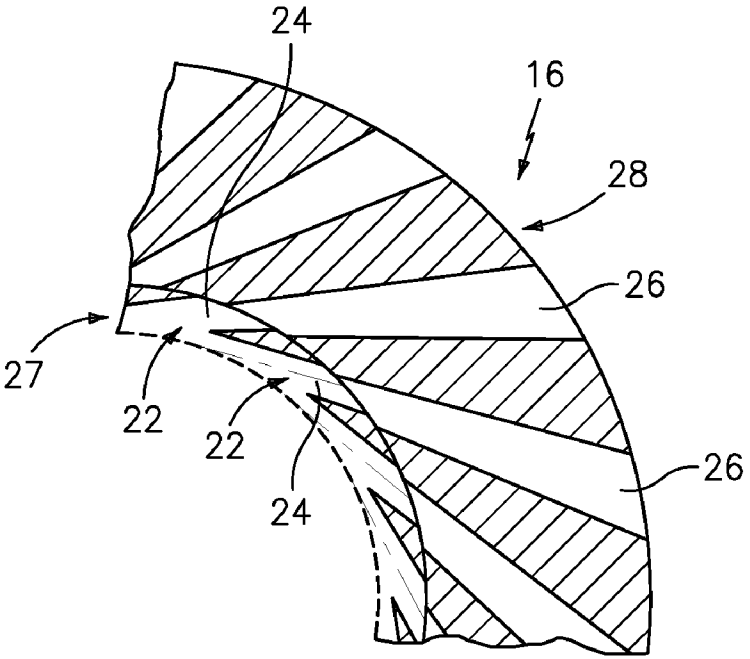
FIGS. 2 and 2*a* show perspective and sectional views, respectively, of a variable geometry diffuser suitable for use in accordance with the present invention.
Figure 2:
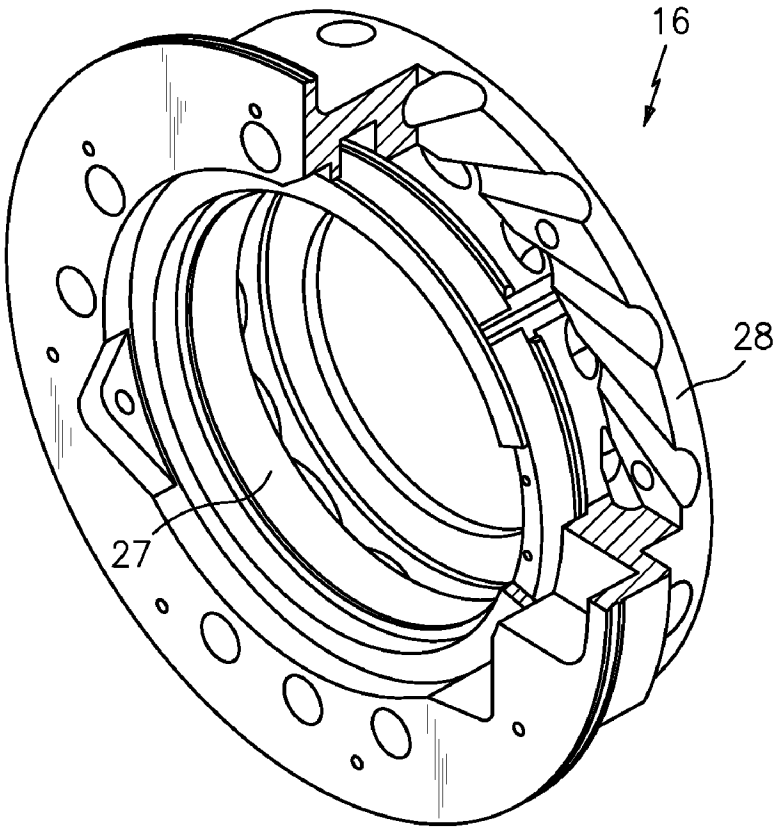

FIGS. 2 and 2*a* show perspective and cross sectional views, respectively, of one preferred embodiment of pipe diffuser geometry. As set forth above, the pipe diffuser also serves as a flow stability device. As shown in FIGS. 2 and 2*a*, a rotatable inner ring 27 is provided that adjusts the throat area of the diffuser depending on angular rotation relative to an outer ring portion 28. It is this rotation that is referenced throughout this application as diffuser orientation.

It should be appreciated that the variable geometry diffuser illustrated in FIGS. 2 and 2*a* is a non-limiting example of one embodiment of this structure, and other types of controllable diffusers are well within the broad scope of the present invention.

It should be appreciated that the variable geometry diffuser illustrated in FIGS. 2 and 2*a* is a non-limiting example of one embodiment of this structure, and other types of controllable diffusers are well within the broad scope of the present invention.

An example of analysis of a loading parameter follows.

The invention encompasses using a loading parameter in instances where other compressor components or operating settings drive onset of surge. One example of an alternative embodiment in this category is where impeller instability is the concern. As set forth herein, a loading parameter relevant to onset of surge due to impeller instability can be determined and used to control changes in operating conditions to maximize efficiency while maintaining stable operation.

Figure 3:
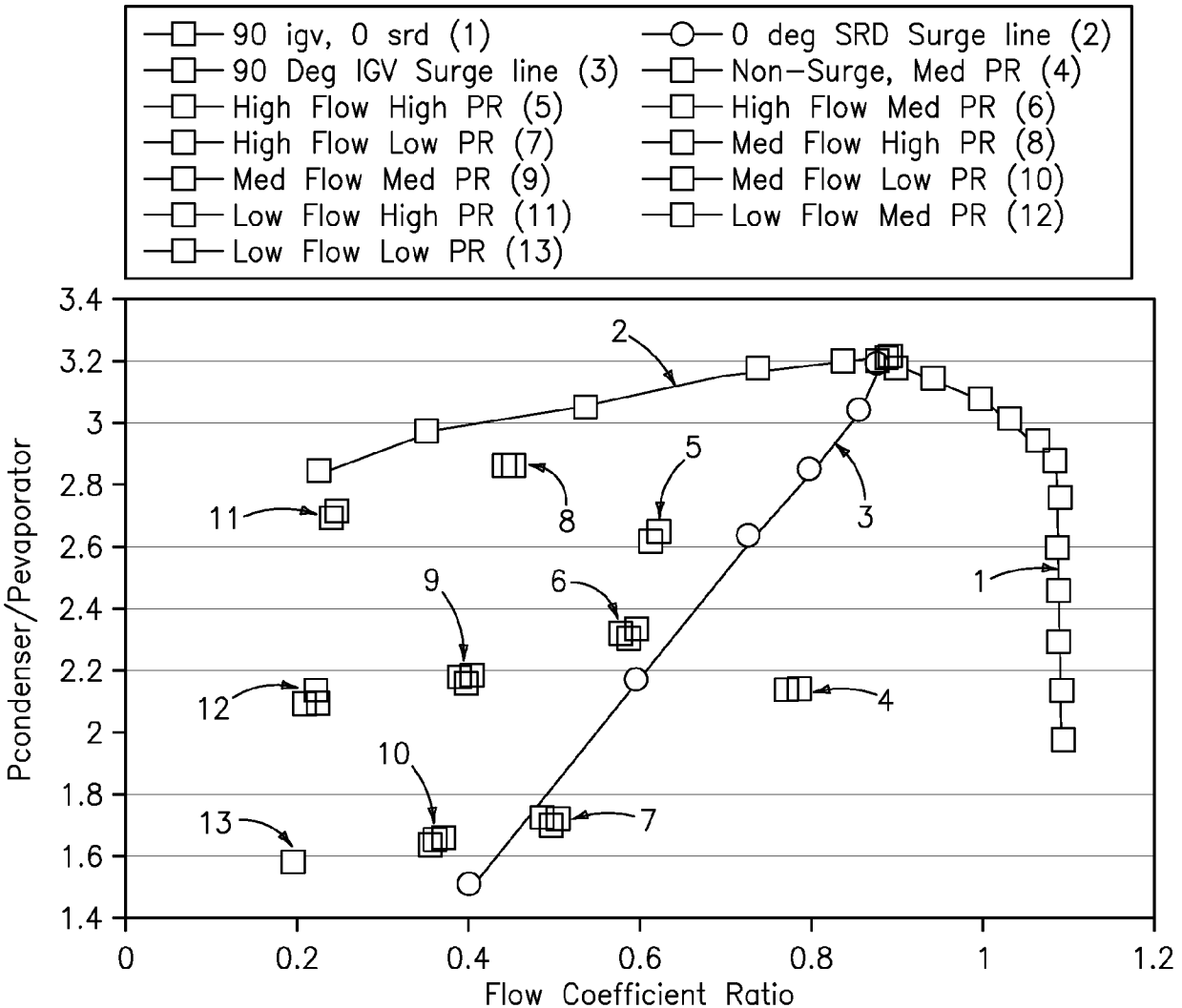
FIG. 3 illustrates performance characteristics and surge zone for a centrifugal compressor.

To illustrate the effects of variable diffuser orientation on flow efficiency and stability, the surge line with a fully open diffuser using only IGV's as flow control is first determined (see line 3, FIG. 3). In this figure, Pevaporator is the evaporator static pressure and Pcondenser is the condenser static pressure. Also, the surge line for fully open IGV and only using the variable diffuser geometry orientation as flow control is denoted (see line 2, FIG. 3). Between these two lines is the potentially unstable or surge operating region of the compressor. Due to the fact that surge is initiated in the diffuser for this particular compressor system, sensitivity of the surge region was investigated for different diffuser/IGV orientations for the same overall pressure duty.

To determine key physics and a metric to describe the optimal control of the variable diffuser/IGV settings, ten (10) measurement conditions were chosen and are identified by numerals 3-13 in the drawing. Nine (9) of these measurement conditions (points 5-13) were designated by combinations of high, medium and low flow with high, medium, and low pressure operation. Eight (8) of these conditions (points 5-6 and 8-13) are inside the potentially unstable region. To compare to a non-surge flow point, one of the nine (9) combinations (high flow, low pressure, point 7) is selected to be outside the surge region, and point 4 is selected at a much higher flow point with medium duty and is therefore well inside the stable operation region for this compressor. At each of these operating conditions, different combinations of variable geometry orientation/IGV position were tested and corresponding compressor performance points taken. This is shown in the cluster of points taken for each of the ten pressure rise/flow combinations (FIG. 3).

Figure 4:
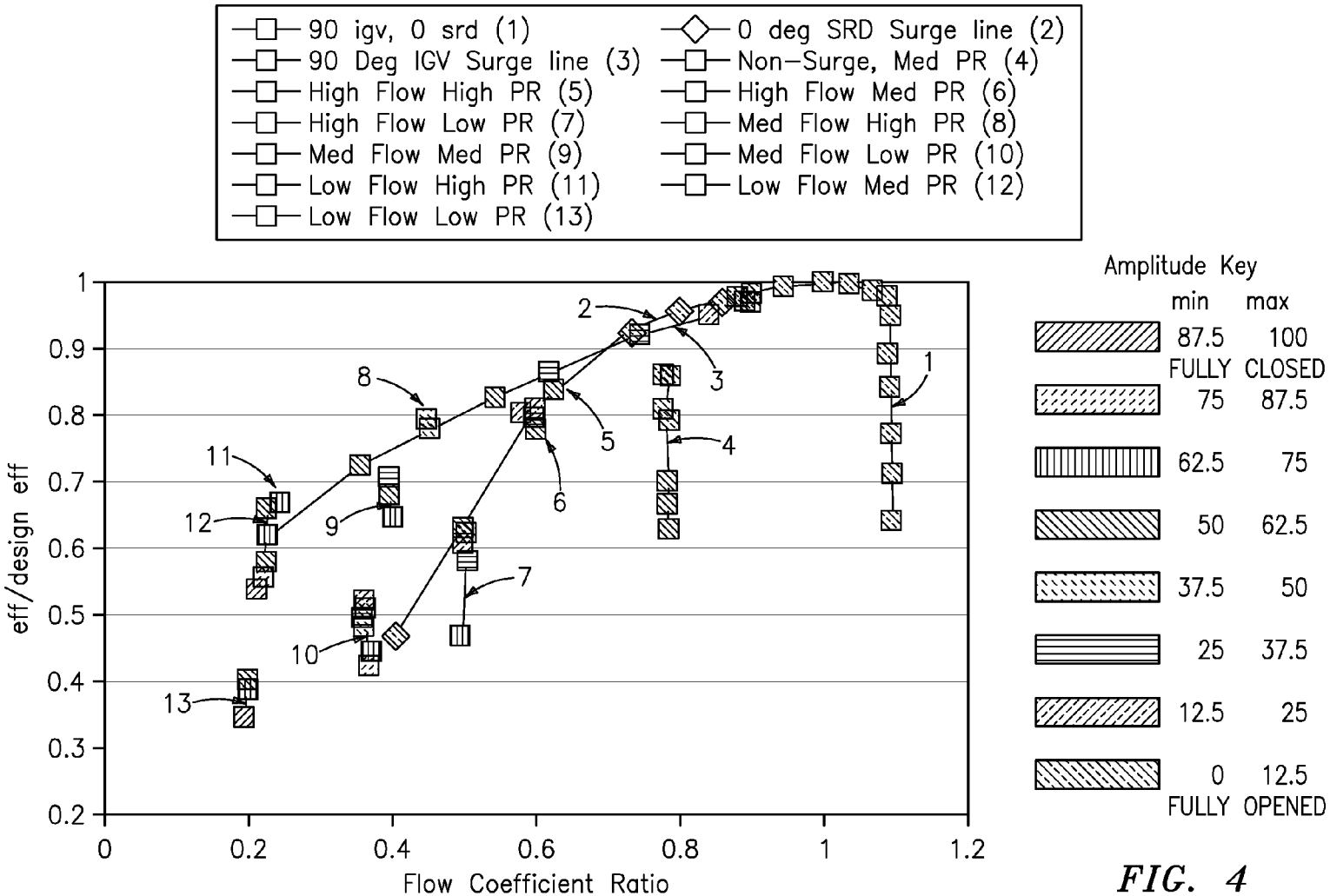
FIG. 4 illustrates efficiency of a compressor system at different zone points, and illustrates a surge line for a fully open variable diffuser, and a maximum surge line using a variable diffuser.

Shown in FIG. 4 are the corresponding efficiency points. As a reminder, each of these points has a constant overall pressure ratio, but now the effect of diffuser geometry orientation can be evaluated. Each of the combination boxes is shaded to correspond to a diffuser geometry location, as shown in the key to this drawing. From FIG. 4 it is clear that as the diffuser is opened, the efficiency is increased, up to the point of surge (or fully opened for the cases inside the stable envelope).

The main objective is to determine what metric will give the correct information of when maximum efficiency (nearest to surge) has occurred while avoiding surge.

Figure 5:
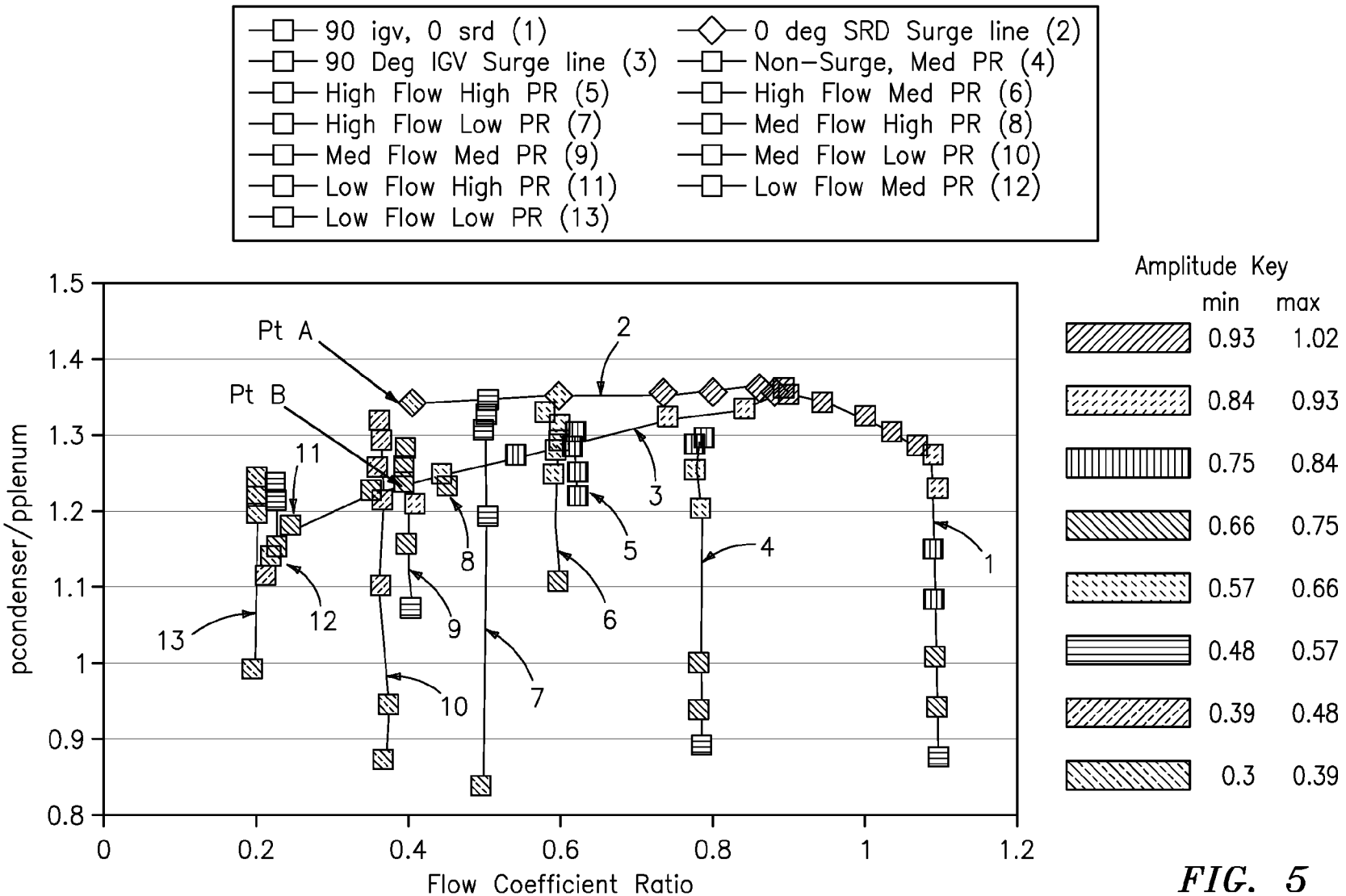
FIG. 5 illustrates the diffuser pressure recovery parameter correlation to efficiency.
Figure 6:
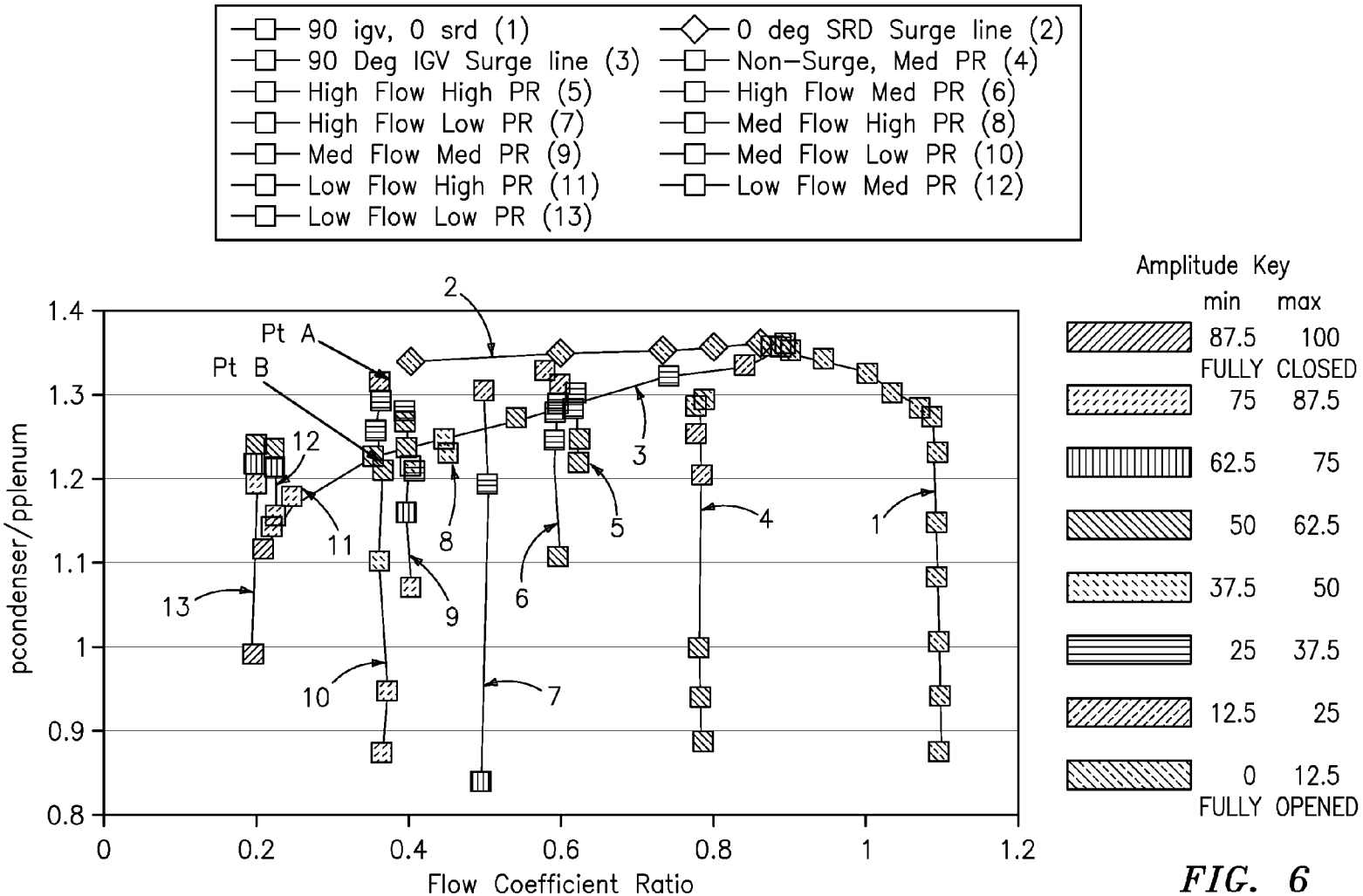
FIG. 6 illustrates the diffuser pressure recovery parameter correlation to flow rate and variable diffuser orientation.

One metric investigated represented the pressure ratio across the diffuser. To make this measurement, pressures were taken before and after the diffuser as described above. As set forth above, for ease of measurement and to get lower fluctuating pressure measurements for a more stable average, the pressure before the diffuser was taken in a plenum chamber adjacent to the vaneless space. Although this plenum pressure measurement does describe the pressure in the vaneless space, it is an estimation of the actual vaneless diffuser space pressure and not precisely accurate. A plot of this ratio (Pcondenser/Pplenum) versus flow is shown in FIGS. 5 and 6.

The remarkable aspect of the Pcondenser/Pplenum metric is that now a narrowly defined region is determined where surge (maximum efficiency) is defined. For example, at 40% of the design flow rate (or a flow coefficient of 0.4) there is only a 7% difference between Pcondenser/Pplenum at fully opened diffuser (1.34 at Pt A) and Pcondenser/Pplenum at the closed diffuser position (1.2 at Pt B). As expected, the more open the diffuser throat, the more diffusion and the higher the efficiency (FIG. 6).

At this point, a curve fit describing the bottom surge line (line 3, FIG. 6) could be determined and used as an upper limit to the diffuser parameter during operation. This would in effect be a conservative control. To further increase system efficiency, some more information is needed.

Because there is still not a total collapse of the Pcondenser/Pplenum metric at surge (FIG. 6), it was determined that not all the physics of the problem have been accounted for. The correct orientation of the diffuser geometry was incorporated into the analysis. To do this Pcondenser/Pplenum is plotted against the diffuser orientation (FIG. 7).

Figure 7:
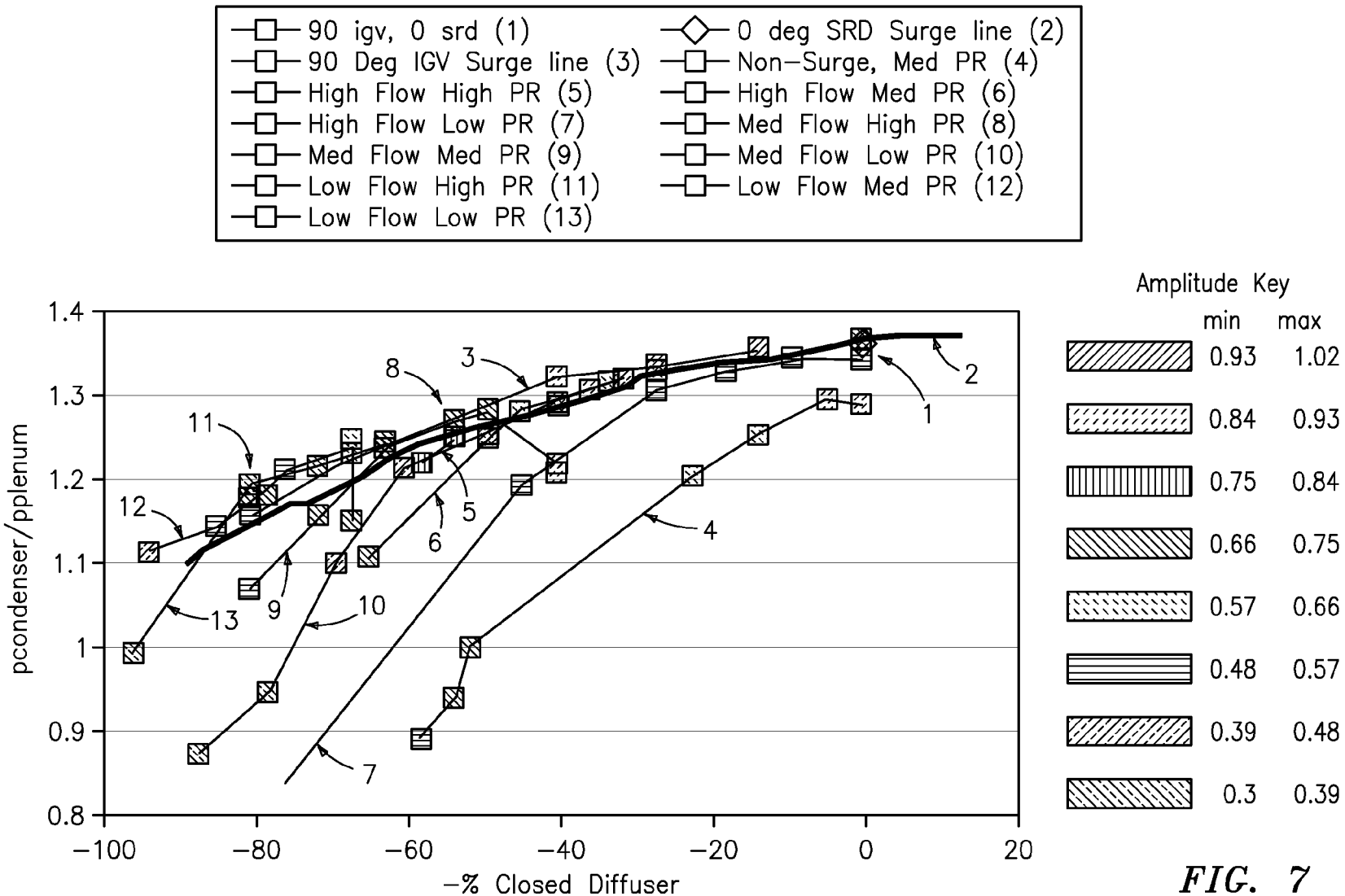
FIG. 7 illustrates the diffuser pressure recovery parameter correlation to variable diffuser orientation.
Figure 8:
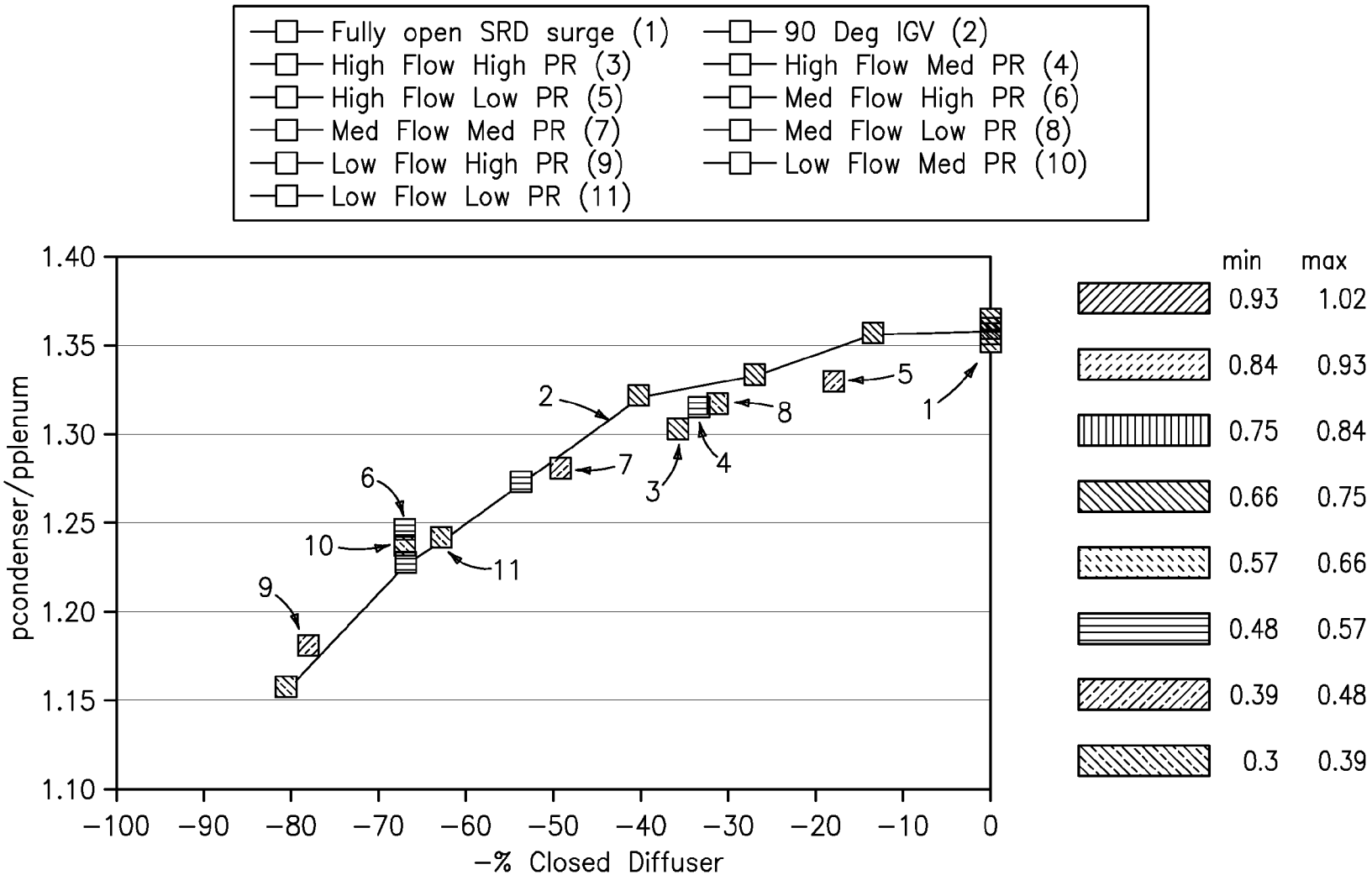
FIG. 8 illustrates correlation of diffuser pressure recovery parameter vs. diffuser orientation.

Surge can be seen to fall along a single line (line 2 on FIG. 7). There is a defined curve of maximum attainable diffuser pressure rise that is possible for any given diffuser orientation. To demonstrate the collapse further, only the points from FIG. 7 of maximum efficiency at the 8 test points in the surge zone are plotted along with the two surge lines (FIG. 3). This, in essence, is a subset of the data shown in FIG. 7 and defines the upper limit of the pressure recovery of the diffuser (line 21, FIG. 8).

Now it is clearly defined when maximum efficiency (or surge) will occur and a control scheme based on the current diffuser orientation can easily be devised to utilize this curve to control for maximum efficiency. As the current value of Pcondenser/Pplenum approaches the maximum value of Pcondenser/Pplenum (with an added factor of safety) for a given diffuser orientation, the system can now be stopped short of surge for maximum efficiency. The control curve can be determined by a minimal amount of test points (4-8) along any surge line. Also, a minimal amount of measurements are necessary (namely shroud plenum pressure, condenser pressure and diffuser orientation) to optimize the system.

Figure 9:
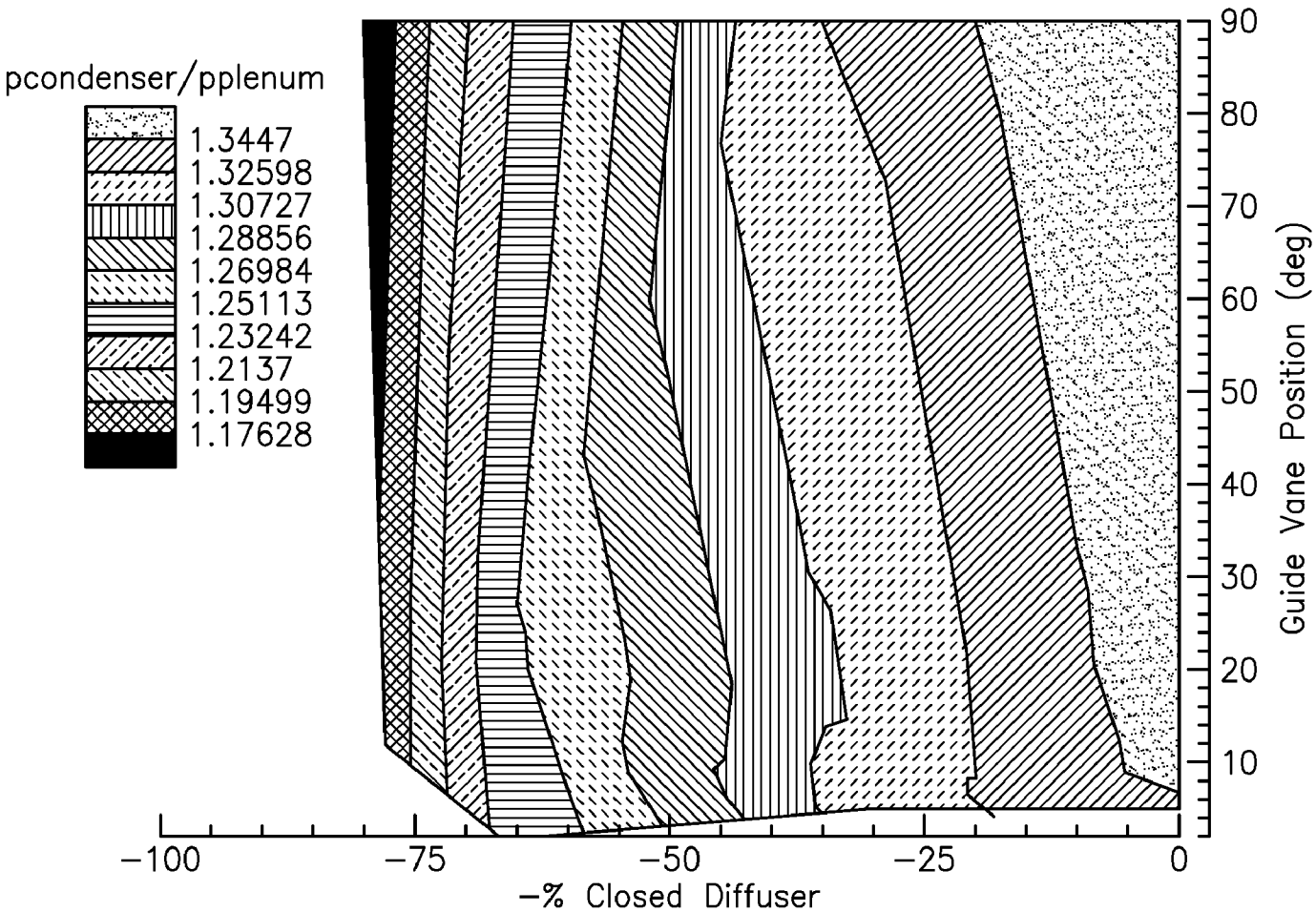
FIG. 9 illustrates the effect of IGV and diffuser orientation on the diffuser pressure recovery parameter.

It is also important to note that in no way is the IGV orientation expressly used to define this curve, and the surge criterion is determined mainly by the diffuser orientation. The weak function of Pcondenser/Pplenum on IGV location is shown in FIG. 9. FIG. 9 is a contour chart of the data presented in FIG. 8 with the third dimension being the IGV position. The vertical contours in FIG. 9 show that the value of Pcondenser/Pplenum is relatively constant at surge for diffuser position, irrespective and independent of IGV location.

Figure 10:
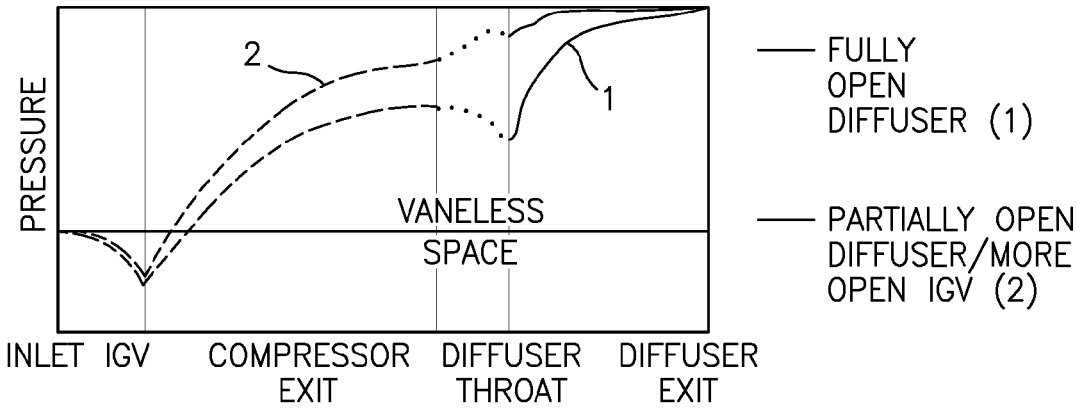
FIGS. 10 and 11 illustrate compressor component pressure rise for two different IGV/diffuser settings at the same overall load.

The previous data analysis showed the utility of using the Pcondenser/Pplenum metric with diffuser orientation to determine the optimal operational combination of diffuser and IGV settings in the possible surge region (shown in FIG. 3) for the highest efficiency. To describe the physical processes and why this metric works, the following pictorial description of the pressure rise through the compressor/diffuser system will be used (FIG. 10).

Figure 11:
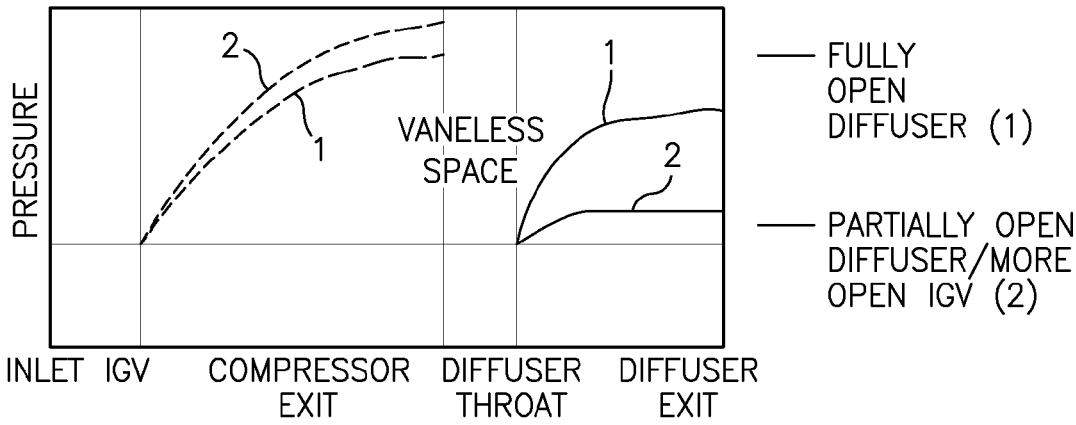

Two cases are described making the same pressure duty, one with a fully open diffuser, the other with the diffuser at some arbitrary closed position. The fully open diffuser has the largest static recovery coefficient. This is depicted by the larger increase in diffuser pressure recovery for the fully open diffuser case (FIGS. 10 and 11). Therefore, in order to make the same pressure duty, the compressor for the fully opened diffuser case must be operating at a lower pressure rise (FIG. 11), i.e. more closed IGV positioning. This means that more pre-swirl is present for the fully open diffuser case than any closed case and will adversely affect the operational efficiency.

Because losses of this system are dominated in the diffuser region when the diffuser is significantly closed, where pressure recovery coefficients for closed diffuser cases can be less than half that of the fully open case, the previously described small losses in efficiency in the compressor region due to more pre-swirl are more than offset by the increased losses in the diffuser.

The upshot of this is that the more opened the diffuser is, the more efficient the system becomes. Also, because stability (surge) characteristics of the system is dominated by the flow in the diffuser, both maximum efficiency and surge occur at very nearly the same point. Therefore, it is no surprise that the metric that describes the diffuser performance ($P_{condenser}/P_{plenum}$) is a good gauge of both stability and system efficiency.

The foregoing has detailed a methodology and measurement standards that can be used to optimize a centrifugal compressor system that has inlet flow control with a variable diffuser geometry and where system stability is driven by the diffuser. The measurement metrics are the pressure ratio across the diffuser and diffuser orientation. For any given diffuser orientation, there is a maximum attainable pressure recovery value for stable operation. This is completely analogous to a maximum pressure recovery coefficient before separation in a classic parallel walled diffuser. In a centrifugal compressor system, this separation feeds into the system flow field and generates an unsteady and unstable flow.

Given that the diffuser efficiency increases as the diffuser is opened, and the most open a diffuser can be is determined by the diffusion stability (stall and surge), it is not surprising that a pressure recovery value would be a predictor of both surge and maximum efficiency.

The above data indicates that a control scheme is possible that utilizes a measured pressure ratio across the diffuser to bound the operating conditions. The pressure measured before and after the diffuser are taken in plenum conditions, namely, inside an adjacent chamber to the vaneless diffuser for the upstream value and inside the condenser for the downstream value. This is done to reduce the effects of transients on the measured pressure.

For any given diffuser orientation there is a maximum attainable pressure recovery value irregardless of the inlet guide vane setting. The control scheme can be set up to insure that the diffuser operates as open as possible (maximum efficiency) but never above the maximum pressure recovery value (stall and surge).

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. A method for controlling operation of a compressor having an inlet and an outlet, a variable geometry diffuser communicated with the outlet, and inlet guide vanes communicated with the inlet, comprising the steps of:

determining a loading parameter indicative of onset of surge; and independently controlling the variable geometry diffuser and at least one of compressor speed and the inlet guide vanes based upon the loading parameter so as to allow increase in efficiency and stable operation of the compressor, wherein the independently controlling comprises:

determining from the loading parameter whether a desired change in compressor operation would cause surge if carried out with the variable geometry diffuser;

carrying out the desired change by controlling the variable geometry diffuser when the loading parameter indicates that surge would not be caused; and carrying out the desired change by controlling at least one of compressor speed and the guide vanes when the loading parameter indicates that surge would be caused.

2. The method of claim 1, wherein the loading parameter comprises pressure ratio across the variable geometry diffuser.

3. The method of claim 1, wherein the controlling step comprises independently controlling the variable geometry diffuser and the inlet guide vanes.

4. A compressor system, comprising:

a compressor having an inlet and an outlet, a variable geometry diffuser communicated with the outlet, and inlet guide vanes communicated with the inlet; and a controller programmed with information corresponding to a loading parameter indicative of onset of surge; and adapted to independently control the variable geometry diffuser and at least one of compressor speed and the inlet guide vanes based upon the loading parameter so as to allow increase in efficiency and stable operation of the compressor, wherein the controller is programmed to:

determine from the loading parameter whether a desired change in compressor operation would cause surge if carried out with the variable geometry diffuser;

carry out the desired change by controlling the variable geometry diffuser when the loading parameter indicates that surge would not be caused; and carry out the desired change by controlling at least one of compressor speed and the guide vanes when the loading parameter indicates that surge would be caused.

5. The system of claim 4, wherein the controller is programmed with information corresponding to pressure ratio across the variable geometry diffuser as the loading parameter.

6. The system of claim 4, wherein the controller is programmed to independently controlling the variable geometry diffuser and the inlet guide vanes.

7. A method for controlling operation of a compressor having at least two controllable operating parameters which affect operating stability, comprising the steps of:

determining a loading parameter indicative of onset of surge, an operating value of the loading parameter being controllable by each of the at least two controllable operating parameters; and independently controlling at least one of the at least two controllable operating parameters based upon the loading parameter so as to operate at a desired efficiency within a stable operating zone of the compressor, wherein the independently controlling comprises:

determining from the loading parameter whether a desired change in compressor operation would cause surge if carried out with the variable geometry diffuser;

carrying out the desired change by controlling the variable geometry diffuser when the loading parameter indicates that surge would not be caused; and carrying out the desired change by controlling at least one of compressor speed and the guide vanes when the loading parameter indicates that surge would be caused.

8. The method of claim 7, wherein the loading parameter comprises pressure ratio across the variable geometry diffuser.

* * * * *